US009249545B2

(12) United States Patent
Franzmann et al.

(10) Patent No.: US 9,249,545 B2
(45) Date of Patent: Feb. 2, 2016

(54) ROAD MILLING MACHINE, IN PARTICULAR SMALL MILLING MACHINE, FOR WORKING ROAD SURFACES

(71) Applicant: Wirtgen GmbH, Windhagen (DE)

(72) Inventors: Dirk Franzmann, Hennef (DE); Christian Berning, Brühl (DE); Philip Verhaelen, Köln (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/268,510

(22) Filed: May 2, 2014

(65) Prior Publication Data

US 2014/0333117 A1 Nov. 13, 2014

(30) Foreign Application Priority Data

May 10, 2013 (DE) ..... 10 2013 208 645

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 1,541,499 | A * | 6/1925 | Hinnekens | 184/11.1 |
| 3,608,968 | A * | 9/1971 | Burnett | 299/39.2 |
| 5,259,692 | A * | 11/1993 | Beller et al. | 404/90 |
| 6,106,073 | A | 8/2000 | Simons et al. | |
| 6,997,641 | B2 | 2/2006 | Gaertner et al. | |
| 2005/0158120 | A1 * | 7/2005 | Holl et al. | 404/94 |
| 2008/0205983 | A1 * | 8/2008 | Kraemer | 404/87 |

FOREIGN PATENT DOCUMENTS

| | | | |
|---|---|---|---|
| DE | 3510596 | A1 | 9/1986 |
| DE | 19631042 | A1 | 2/1998 |
| DE | 10347873 | A1 | 5/2005 |
| DE | 102010014529 | A1 | 10/2011 |
| EP | 2374937 | A2 * | 10/2011 |

* cited by examiner

*Primary Examiner* — John Kreck
(74) *Attorney, Agent, or Firm* — Lucian Wayne Beavers; Patterson Intellectual Property Law, PC

(57) ABSTRACT

In a road milling machine, in particular small milling machine, for working road surfaces, with a machine frame, with a milling drum supported at the machine frame in a drum casing, with a milling drum drive comprising a drum gearbox mounted at the drum casing, where the drum gearbox comprises a gearbox housing with a connecting flange for mounting at the drum casing, as well as a reduction gearbox and an output shaft for driving the milling drum, it is provided for the following features to be achieved: that the gearbox housing comprises, on the underside between the reduction gearbox and the connecting flange, a cut-out dividing the gearbox housing and extending radially inwards in such a fashion that the reduction gearbox is arranged in a first housing part arranged outside of the drum casing, and the output shaft is arranged in a second housing part protruding into the drum casing.

16 Claims, 3 Drawing Sheets

ROAD MILLING MACHINE, IN PARTICULAR SMALL MILLING MACHINE, FOR WORKING ROAD SURFACES

BACKGROUND OF THE INVENTION

1. Field of the Invention

The invention relates to a road milling machine, in particular small milling machine, for working road surfaces.

2. Description of the Prior Art

Such small milling machine is known, for example, under the designation Wirtgen W 50 DC. The basic design of a generic road milling machine is known from DE 196 31 042 A1.

The small milling machine comprises a cantilevered milling drum which is mounted at the machine frame in a drum casing and can be driven by a milling drum drive.

The known milling drum drive comprises a drum gearbox that is arranged in part inside the drum casing and in part outside of the drum casing. To this effect, the drum gearbox is attached at a front wall of the drum casing by means of a connecting flange.

In a known drum gearbox according to DE 10 2010 014 529 A, at least one part of the reduction gearbox is arranged in the gearbox housing located in the drum casing so that, in the upper area of the gearbox housing, which is eccentric relative to the output shaft of the drum gearbox, the cantilevered milling drum encloses said gearbox housing with a relatively small gap. Such gearbox housing protruding into the drum casing has the disadvantage that milled material penetrating into the interior of the milling drum collects in the narrow gap between the gearbox housing and the interior skin of the milling drum where it leads to increased friction and wear and, ultimately, to a loss in performance. In extreme cases, the milled material can become wedged in the gap and block the milling drive which can cause considerable damage to the road milling machine. This is aggravated further by the fact that not only the narrow gap alone but the wedged shape of the gap causes the problems when a milling drum of circular cross-section is put over an extension housing that is eccentric or non-rotationally symmetrical to the output shaft. Owing to the wedged shape and with a stationary extension housing and rotating milling drum, the milled material is drawn into the gap and compressed.

A further disadvantage of the known prior art is that milling drums with a relatively small diameter or a spherical shape cannot be used due to the fact that the gearbox housing makes almost full use of the free interior space of the milling drum towards the top.

Finally, a further disadvantage of the known design is to be seen in the fact that the housing part located outside of the drum casing is at a higher level than the housing part located inside the drum casing, thus necessitating two separate oil supply systems. The separate oil supply systems require additional components, such as pumps or oil coolers, and exhibit temperature problems due to the lack of temperature compensation between the two gearbox parts.

SUMMARY OF THE INVENTION

It is therefore the object of the present invention to improve a road milling machine, in particular a small milling machine, of the type first mentioned above to the effect that the susceptibility to failure of the drum gearbox is reduced and the range of possible applications of the road milling machine is broadened.

The invention advantageously provides for the gearbox housing to comprise, on the underside between the reduction gearbox and the connecting flange, a cut-out dividing the gearbox housing and extending radially inwards in such a fashion that, the reduction gear is arranged in a first housing part arranged outside of the drum casing, and the output shaft extends into is arranged in a second housing part protruding into the drum casing.

The invention provides for the reduction gearbox to be arranged entirely outside of the drum casing so that the second housing part protruding into the drum casing can be designed essentially rotationally symmetrically with a minimum cross-section. Blocking of the milling drum by milled material is thus safely precluded, in which case the wear on the interior skin of the milling drum and the second housing part is also additionally minimized.

A further advantage is offered in that a multitude of special milling drums with reduced cutting circle as well as milling drums with variable diameter in axial direction, such as spherically shaped milling drums, can be used. The vertical cut-out arranged at the underside between the reduction gearbox and the connecting flange can accommodate a movable side plate which can largely prevent milled material from escaping from the interior of the drum casing with different milling depths of the drum casing.

It is preferably intended for the reduction gearbox to be located entirely inside the first housing part and for the output shaft to extend from the reduction gearbox into the second housing part located inside the drum casing. It is thus intended for the housing part located inside the drum casing to accommodate only the output shaft. Owing to the fact that the second housing part accommodates only the output shaft as well as the bearing required for the same, the outer diameter of the second housing part is reduced to a diameter that is essentially determined only by the outer diameter of the bearing and the wall thickness of the gearbox housing. In view of this, the diameter of the second housing part can be reduced to the greatest possible extent and can assume an essentially rotationally symmetrical cross-sectional shape.

It is preferably intended for the distance of the housing wall of that part of the housing protruding into the drum casing from the output shaft in the area of the cut-out to be reduced to a gap permitting the circulation of oil.

At the underside, the gearbox housing is preferably recessed in a U-shape. This means that the cut-out extending radially inwards additionally extends vertically upwards laterally next to the output shaft. In this fashion, a lateral sealing of the drum casing by means of a side plate can also be achieved for different milling depths.

The U-shaped cut-out in the lower housing comprises an angular range about the rotational axis of the output shaft of, for example, 180° to 300°, preferably more than 240°. Such cut-out may interact with a cut-out adapted to the same in a lateral protection device, for example, a vertical side plate, in order to seal the drum casing on the drive side.

A particularly preferred embodiment intends for a feeding device in the first housing part to feed oil into the upper area of the reduction gearbox. From there the oil can flow, for example, via a channel, into the housing part protruding into the drum casing, in this fashion enabling the circulation of oil in a single oil supply system.

The feeding device may be an element of the reduction gearbox.

A gear of the reduction gearbox rotating in the oil sump is preferably used for this purpose to feed the oil into a collecting reservoir from where the oil is feedable, via at least one channel, to the second gearbox part containing only the output shaft. In this arrangement, the channel may extend up to the bearing of the output shaft at its free end.

In this arrangement, the part of the housing protruding into the drum casing may feature a diameter that is only slightly larger than the maximum diameter of the bearing for the output shaft.

The housing part protruding into the drum casing preferably features an essentially rotationally symmetrical cross-sectional shape.

A preferred embodiment intends for the outer front end of the cantilevered milling drum to end nearly flush with the lateral outer side of the machine frame, the so-called zero-clearance side, in order to enable milling as close along any obstacles as possible. In this arrangement, the machine frame is preferably supported by a chassis comprising a front axle and a rear axle with wheels, with the milling drum being arranged between the rear wheels. This arrangement concerns the normal operation of the road milling machine in which both rear wheels are arranged coaxially and preferably in a vertical plane with the milling drum axis. With close-to-edge operation, a pivoting rear wheel may be provided on the zero-clearance side which can be pivoted into a position in front of the milling drum and inwards relative to the zero-clearance side. Such arrangement is also known, for example, from DE 103 47 873 A1.

The road milling machine is preferably a rear-loading milling machine in which a transport device for the milled material worked off by the milling drum discharging towards the rear is arranged behind the milling drum as seen in the direction of travel.

In the following, one embodiment of the invention is explained in greater detail with reference to the drawings.

BRIEF DESCRIPTION OF THE DRAWINGS

The following is shown.

DETAILED DESCRIPTION

Figure 1:
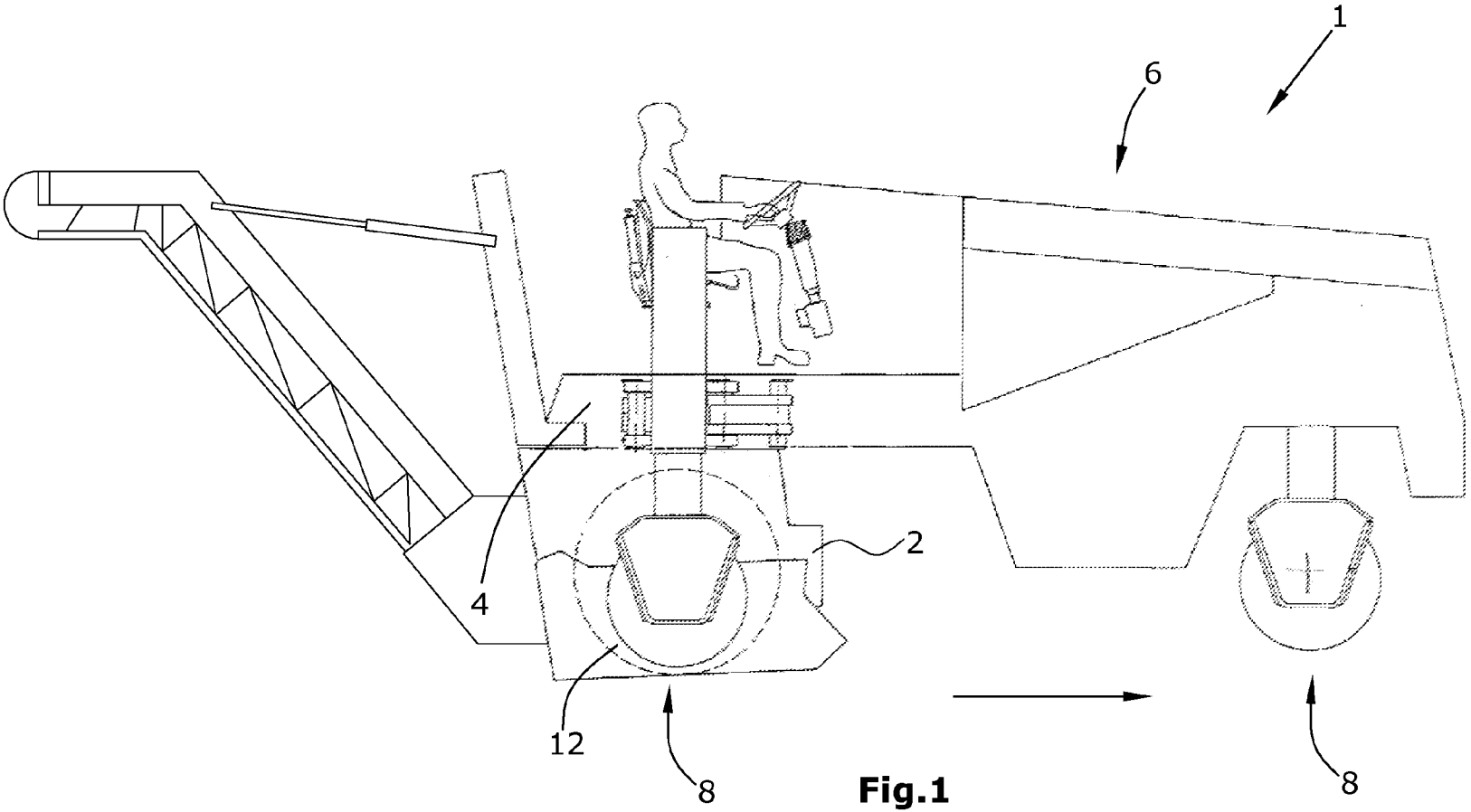
FIG. 1 a small milling machine.

The automotive road milling machine 1 for working road surfaces depicted in FIG. 1, for example, a small milling machine, comprises a machine frame 4 as well as a drive engine 6 for the driving of travelling mechanisms 8 and of working devices. In the embodiment in FIG. 1, the travelling mechanisms 8 are comprised of wheels but may also be comprised, wholly or in part, of crawler tracks. The main working device is comprised of a milling drum 12 for milling the road surface, where said milling drum 12 is capable of being driven by a milling drum drive with a drum gearbox 10.

Figure 2:
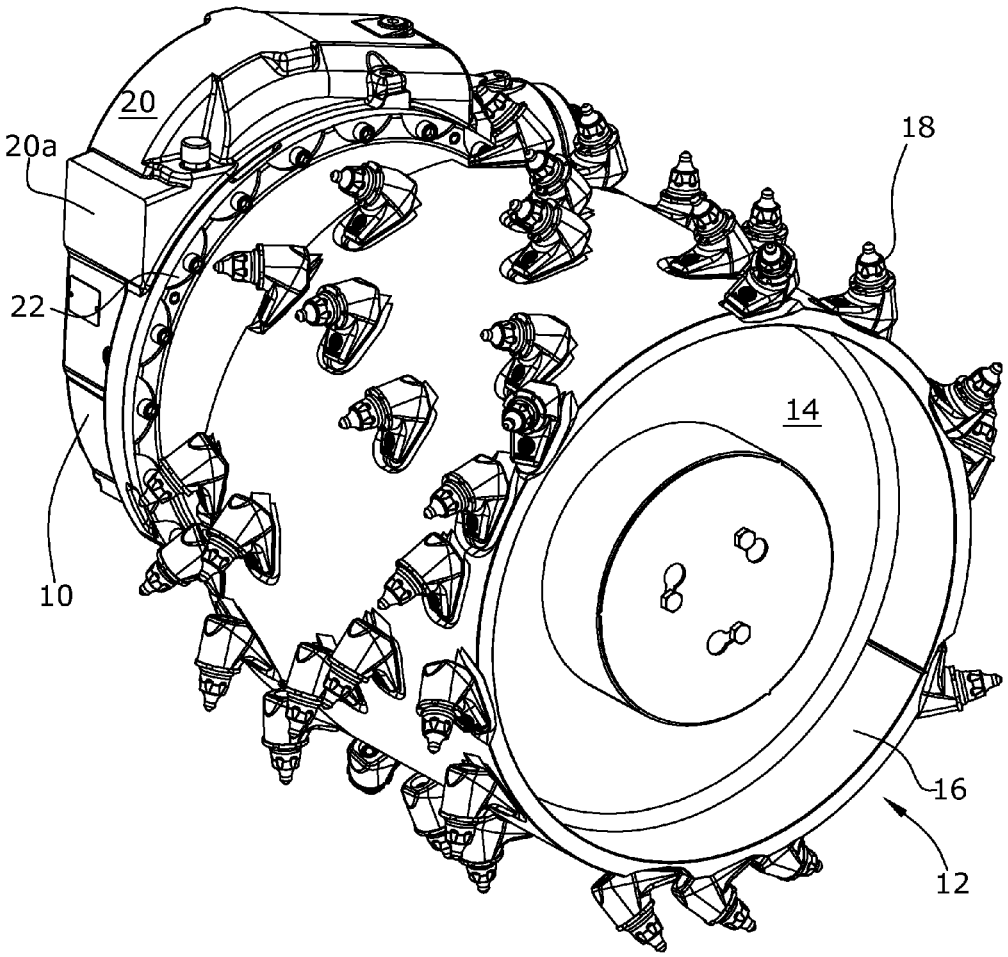
FIG. 2 the milling drum mounted on a milling drum drive.

FIG. 2 shows a perspective view of the mounted milling drum 12 with a connecting flange 14 and a drum 16 which carries a multitude of systematically arranged tools 18.

Figure 3:
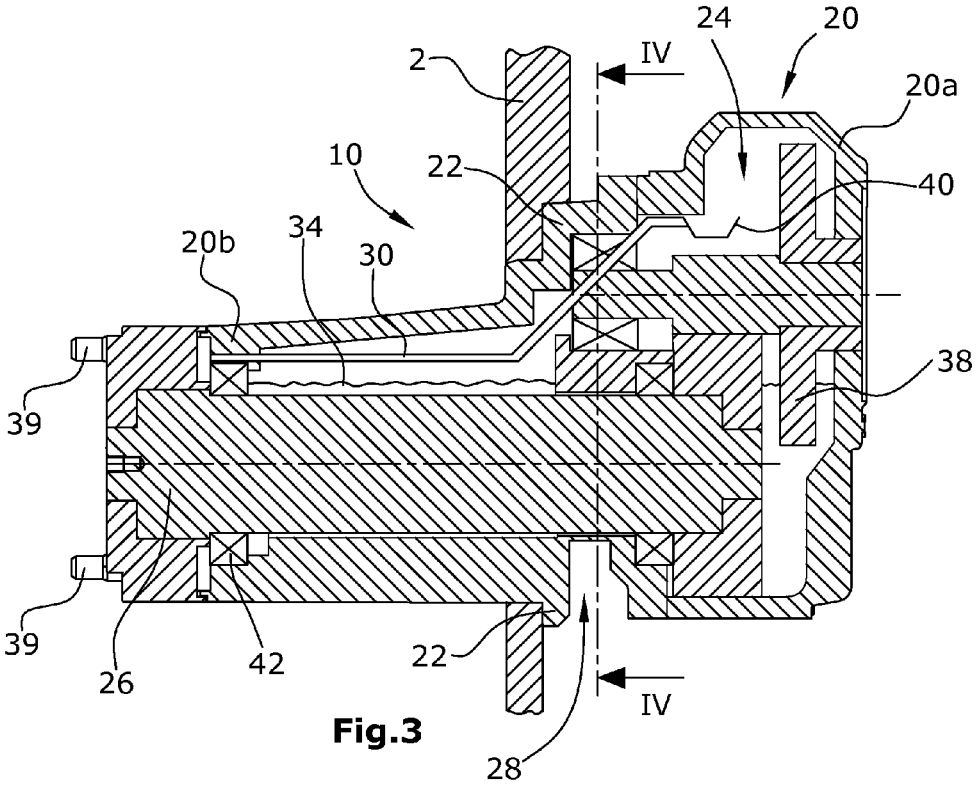
FIG. 3 a section of the drum gearbox.

FIG. 3 shows a section through the drum gearbox 10 with a gearbox housing 20 which can be fastened at a front wall of the drum casing 2 in such a fashion that a first housing part 20*a* with a two-stage reduction gearbox 24 is arranged outside of the drum casing 2 and a second housing part 20*b* protrudes into the drum casing 2 through an opening in the front wall of the drum casing 2. The front wall of the drum casing 2 is not shown in FIG. 2. The reduction gearbox 24 may also be referred to as a reduction gear 24.

At the free end of the housing part 20*b* protruding into the drum casing 2, stud bolts 39 for fastening the milling drum 12 project axially, said stud bolts 39 being coupled to the output shaft 26 in a torsionally rigid fashion.

Figure 4:
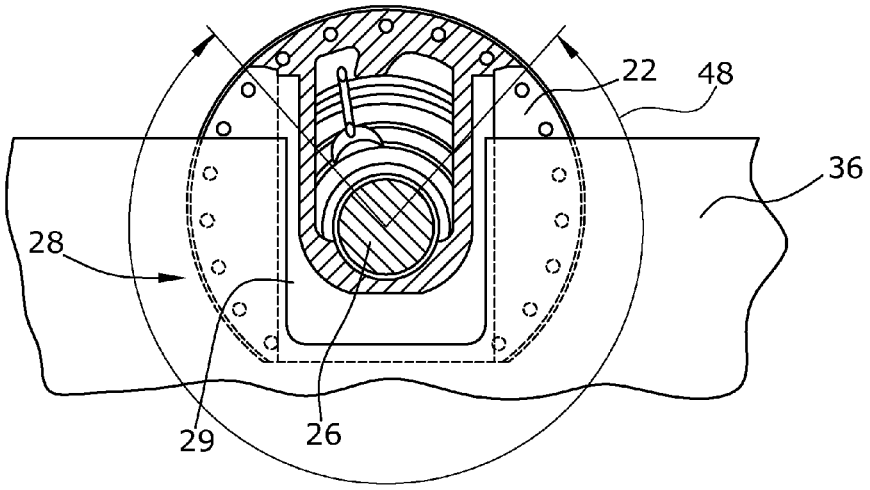
FIG. 4 a section along line IV-IV in FIG. 3.

At the underside of the gearbox housing 20, between the connecting flange 22 for attachment at the front wall of the drum casing 2 and the reduction gearbox 24, a cut-out 28 is intended which extends in a U-shape in the surroundings of the output shaft 26 as can best be inferred from FIG. 4.

The cut-out 28 extends both below the output shaft and to the side of the same, thus enabling the accommodation of a movable side plate 36 for lateral sealing of the drum casing 2, with said side plate 36 exhibiting a complementary cut-out 29 adapted to the shape of the cut-out 28.

The cut-out 28 in the lower gearbox housing 20 preferably comprises an angular range 48 inferable from FIG. 4 about the rotational axis of the output shaft 26 of approx. 180° to 300°, preferably more than 240°.

By means of a gear 38 of the reduction gearbox 24, oil can be fed from the lower part of the gearbox housing 20 upwards into a collecting reservoir 40 from where the oil can be transported, via a channel 30, into the second housing part 20*b* up to a bearing 42 at the free end of the output shaft 26. In this fashion, an installation space-saving and energetically neutral pump has been created by means of a gear 38 rotating in the oil sump feeding oil into the collecting reservoir 40. The oil can flow from the collecting reservoir 40 into the other housing part 20*b* by means of gravitational force. The internal oil flow thus created leads to an optimal temperature distribution of the oil in the drum gearbox 10. The oil level 34 inside the gearbox is indicated as an undulating line.

What is claimed is:

1. A road milling machine, comprising:

a machine frame;

a drum casing attached to the machine frame;

a milling drum supported from the machine frame in the drum casing; and a milling drum drive including a drum gearbox mounted on the drum casing, the drum gearbox including:

a gearbox housing including a connecting flange, the connecting flange attached to the drum casing, the gearbox housing including on an underside a cut-out extending radially inwards and dividing the gearbox housing into a first housing part arranged outside of the drum casing and a second housing part protruding into the drum casing;

a reduction gear located in the first housing part outside of the drum casing; and an output shaft extending from the first housing part into the second housing part, and connected to the milling drum to drive the milling drum.

2. The machine of claim 1, wherein:

the reduction gear is located entirely inside the first housing part; and the output shaft extends from the reduction gear into the second housing part located inside the drum casing.

3. The machine of claim 1, wherein:

adjacent the cut-out, a distance between a housing wall of the gearbox housing and the output shaft is reduced to a gap permitting circulation of oil.

4. The machine of claim 1, wherein:

at the cut-out in the underside of the gearbox housing, the gearbox housing is recessed in a U-shape.

5. The machine of claim 1, wherein:

the cut-out in the underside of the gearbox housing comprises an angular range about a rotational axis of the output shaft of from 180° to 300°.

6. The machine of claim 5, wherein the angular range is from 240° to 300°.

7. The machine of claim 1, further comprising:

an oil pump arranged to feed oil into an upper area of the reduction gear.

8. The machine of claim 7, wherein:

the oil pump is comprised of an element of the reduction gear.

9. The machine of claim 7, further comprising:

a collecting reservoir arranged to collect oil from the oil pump; and a channel communicating the collecting reservoir to the output shaft in the second housing part.

10. The machine of claim 7, wherein:

the first housing part includes an oil sump; and the oil pump comprises a gear rotating in the oil sump.

11. The machine of claim 1, wherein:

the output shaft rotates in an output shaft bearing; and the second housing part protruding into the drum casing has an outside diameter slightly larger than a diameter of the output shaft bearing.

12. The machine of claim 1, wherein:

the second housing part protruding into the drum casing includes an essentially rotationally symmetrical cross-sectional shape.

13. The machine of claim 1, wherein:

the milling drum includes an outer end nearly flush with a lateral outer side of the machine frame to define a zero-clearance side, such that the milling machine may mill in close proximity to obstacles.

14. The machine of claim 13, further comprising:

a chassis supporting the machine frame, the chassis including a front axle and a rear axle with wheels or crawler tracks, and the milling drum is arranged between the wheels or crawler tracks of the rear axle.

15. The machine of claim 14, wherein:

the wheel or crawler track of the rear axle located on the zero-clearance side is pivotable from an outer position, in which the wheel or track of the rear axle located on the zero-clearance side is located essentially coaxially to the other wheel or crawler track of the rear axle, to an inner position in front of the milling drum and inwards relative to the zero-clearance side.

16. The machine of claim 1, further comprising:

a transport conveyor located behind the milling drum and extending rearwards relative to the direction of travel, such that milled material worked off by the milling drum is transported rearwards away from the milling drum.

* * * * *

UNITED STATES PATENT AND TRADEMARK OFFICE

CERTIFICATE OF CORRECTION

PATENT NO. : 9,249,545 B2
APPLICATION NO. : 14/268510
DATED : February 2, 2016
INVENTOR(S) : Franzmann et al.

It is certified that error appears in the above-identified patent and that said Letters Patent is hereby corrected as shown below:

In the specification,
Column 2, line 7, delete "is arranged in" before --extends into--.

Signed and Sealed this
Tenth Day of May, 2016

Michelle K. Lee

Michelle K. Lee
*Director of the United States Patent and Trademark Office*